US006227386B1

(12) United States Patent
Close

(10) Patent No.: US 6,227,386 B1
(45) Date of Patent: May 8, 2001

(54) SYSTEM AND METHOD FOR PRODUCT DISPLAY, ARRANGEMENT AND ROTATION

(76) Inventor: James Garth Close, 106 Elderberry St., Georgetown, TX (US) 78628

( * ) Notice: Subject to any disclaimer, the term of this patent is extended or adjusted under 35 U.S.C. 154(b) by 0 days.

(21) Appl. No.: 09/634,766

(22) Filed: Aug. 9, 2000

Related U.S. Application Data

(63) Continuation of application No. 09/432,237, filed on Nov. 3, 1999, and a continuation of application No. 09/312,118, filed on May 14, 1999, now Pat. No. 6,155,438.

(60) Provisional application No. 60/194,723, filed on Apr. 4, 2000, and provisional application No. 60/187,590, filed on Mar. 7, 2000.

(51) Int. Cl.[7] ..... A47F 5/00

(52) U.S. Cl. ..... 211/59.3; 312/71; 312/45; 312/72

(58) Field of Search ..... 211/59.3, 59.2, 211/119.003, 90.02; 312/71, 61, 45, 72, 73

(56) References Cited

U.S. PATENT DOCUMENTS 1,702,987 * 2/1929 Wilson .
1,910,046 * 5/1933 Pascoe .
2,079,754 * 5/1937 Waxgiser ..... 312/71
2,980,259 * 4/1961 Fowlds .
5,413,229 * 5/1995 Zuberbuhler et al. ..... 211/59.3
5,469,976 * 11/1995 Burchell ..... 211/59.3
5,881,910 * 3/1999 Rein ..... 211/59.3 X
5,893,467 * 4/1999 Burchell ..... 211/54.1
5,992,650 * 11/1999 Lord ..... 211/59.2
6,155,438 * 12/2000 Close ..... 211/59.3

* cited by examiner

*Primary Examiner*—Robert W. Gibson, Jr.
(74) *Attorney, Agent, or Firm*—David Fink

(57) ABSTRACT

A system for displaying products generally forming a queue having a rear product on a display surface having a rear portion and a front portion, comprising an arranging mechanism operable for moving the products selectively and manually from the rear portion of the display surface towards the front portion of the display surface. The arranging mechanism comprises a positioning element having a vertical portion adapted to engage the rear product in the queue from a rear side of the rear product towards the front portion of the display surface and having a horizontal portion extending generally parallel to the display surface. The system further has a supporting mechanism on each of the products that defines an open pathway from one side of one of the products to a substantially opposite side of the one of the products. The open pathway is adapted to receive the horizontal portion of the arranging mechanism. The horizontal portion is positioned in each of the open pathways and extends under the products so that the vertical portion is positioned to engage the rear product in the vicinity of its geometric center, thereby allowing the rear product to be engaged by the vertical portion for movement from a position in the rear portion to a predetermined position closer to the front portion of the display surface.

21 Claims, 13 Drawing Sheets

FIG. 15A
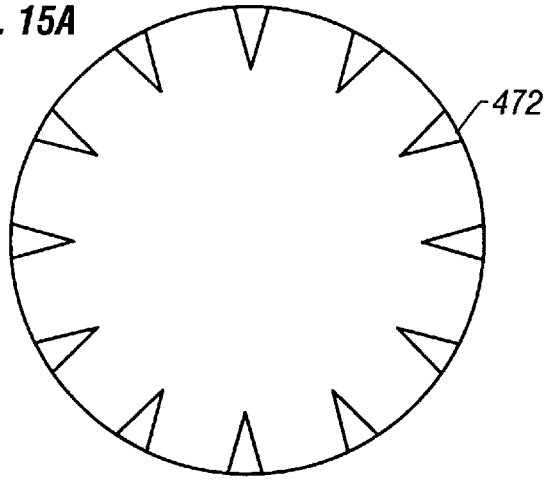
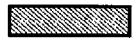
FIG. 15B
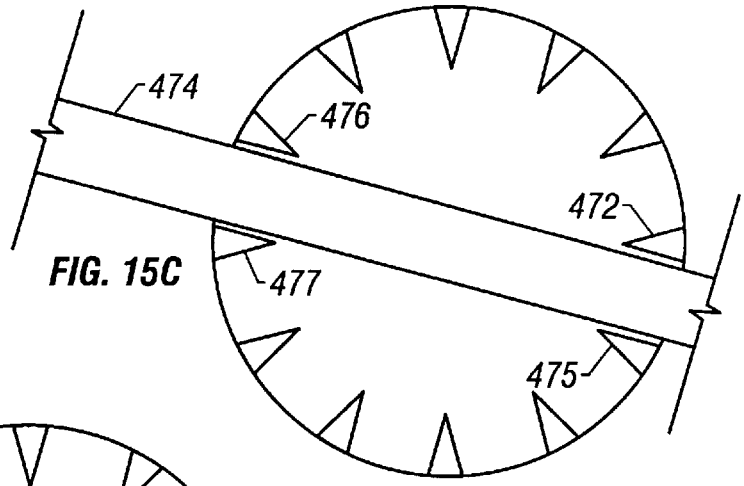
FIG. 15C
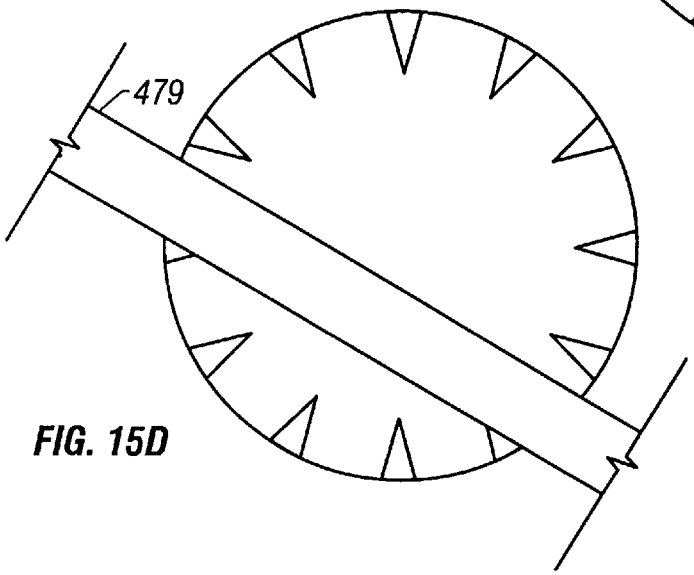
FIG. 15D

SYSTEM AND METHOD FOR PRODUCT DISPLAY, ARRANGEMENT AND ROTATION

CROSS-REFERENCE TO RELATED APPLICATIONS

This nonprovisional patent application is a continuing application of the nonprovisional application having Ser. No. 09/312,118 filed on May 14, 1999 now U.S. Pat. No. 6,155,438. The aforementioned nonprovisional application is hereby incorporated herein by reference.

This nonprovisional patent application is a continuing application of the nonprovisional application having Ser. No. 09/432,237 filed on Nov. 3, 1999. The aforementioned nonprovisional application is hereby incorporated herein by reference.

This nonprovisional patent application is related to the provisional application having Ser. No. 60/187,590 filed on Mar. 7,2000.

This nonprovisional patent application is related to the provisional application having Ser. No. 60/194,723 filed on Apr. 4, 2000.

BACKGROUND OF THE INVENTION

1. Field of the Invention

The invention relates to the display, arrangement and rotation of products such as food boxes, cans and the like in a supermarket, and more particularly to an improved product display, arrangement and rotation system and method in which products displayed on a shelf can easily be arranged or rotated to have the products' expiration dates kept safely up to date and to conveniently position the products manually near the front edge of the shelves for improved visual exposure and effortless selection by consumers. Further, the invention relates to a system and method for maintaining product labels in view of a consumer.

2. Description of the Related Art

Retail stores relying on the consumers to serve themselves have recognized the importance of having products on the shelves near the front edge of the shelves so that the products can be readily seen by consumers and easily reached by the consumers. This merchandising plan is subverted without any nefarious intentions by consumers who purchase the products by removing the products from the shelf, ordinarily from the front of the line of products. As time goes by, the sale of the products results in the removal of additional products until only products formerly in the back remain. In many cases, the products near the back of the shelves are difficult for consumers to reach, particularly when the products are on relatively high shelves and the consumers are shorter than the height of these shelves.

Well operated retail stores have clerks move around the store periodically to check the status of goods and make appropriate corrections by moving products toward the front. The cost of workers today, even for unskilled clerks in supermarkets, is relatively high and can substantially reduce the potential operating profits of the stores. Accordingly, many stores elect to accept poor product displays and awkwardly positioned goods to save on the operating costs. Naturally, this adversely affects sales; however, no quantitative measure is available.

From a subjective point of view, anyone who has encountered a display in which a preferred product was difficult to reach can appreciate the discouraging interest in straining oneself to make a purchase. Consumers often search for a clerk to reach a product, thereby interrupting the clerk from his assigned duties. On the other hand, a determined consumer may risk injury in climbing to reach a product, thereby creating a potential liability for the retail store.

The rotation of products and especially perishable products is a major concern for retail stores and consumers. Perishable products must be sold by a certain date or be pulled from the shelves because of spoilage. If the products are not rotated to the front of the shelf, then as newer products are placed on the shelves, then the older products remain near the rear of the shelves out of the reach of the shopper. Having these older products remain in the rear increases the likelihood that they will not be sold and will be pulled from the shelves or worse yet that they will be purchased by a consumer after their expiration dates have passed. Consumers sometimes forget to review the expiration date of a product and rely on the retail store to maintain up to date safe products. The retail store owner is at the mercy of the product stocker to rotate the products. With the current manual system, where a stocker must manually remove each product by hand, a product stocker may be more inclined to not rotate and just put the newer products towards the front of the shelf, thereby leaving the store open to lost products and lost customers who get sick on spoiled products. A system for the easy rotation of products is needed to decrease the likelihood that a product will have to be discarded after reaching its expiration date.

There have been attempts in the prior art-to provide systems for overcoming the problem of providing an easily operated display system for presenting products near to front of the shelves to enable consumers to reach the products easily. Some of these are discussed in the following.

U.S. Pat. No. 5,203,463 to Steven K. Gold uses springs to "automatically" push items to the front position on the display shelf. Similar systems are currently in use in highly specialized displays such as for cigarette packages. One of the problems with the '463 patent is that to move the cigarette packages forward to a suitable position, the system must be carefully engineered for the weight of the packages as well as the length of the desired movement from the display being full of cigarette packages until only one package is left. This places critical requirements on the spring because it must be selected to be compatible with the weight of the products as well as the distance through which movement is required for substantially all of the products. After the first product is taken, almost a full line of products must be moved. When only a few products remain, the force required for movement is substantially less. This system does not facilitate the rotation the efficient and quick rotation of products for the health and welfare of consumers.

The '463 patent may be satisfactory for a relatively light product such as packages of cigarettes, but it would not be suitable for many heavier goods, such as canned soup, because the heavier goods make the requirements for the spring extremely difficult to fulfill. The spring must be much stronger to properly move a line-up of heavy soup cans and the length of movement required would be a difficult problem to overcome. Typically, food display shelves vary in depth from 24 inches down to 10 inches or less. Anyone who has had experience with springs can appreciate immediately the enormous problems in trying to install such a system throughout a food store with all the variables involved such as heavy products, light products, as well as the differences in the required movement of the spring from compressed to extended to be compatible with product package sizes and various shelf depths. Rotating products is also made difficult by the spring. The old products would need to be removed. The system has no mechanism set up to accept the old products while the newer products are being used to force the spring back. Rotating products with this system is more difficult than having no system in place. Indeed, the likelihood of clerks not rotating may go up if this system is used.

Another problem, besides the springs, with the '463 patent is that the "supporting structure" disclosed in the patent is a complex device which must be especially sized for all the different depths of shelves on which it might he mounted. The width of the device in the '463 patent would need to be easily adjustable. There would be some installations which need to be only a few inches wide, others larger. The store personnel would not be able to install such a system universally. It would require a trained technician with the special tools and skills to do the installations by cutting the base unit into smaller sections. The cost and complexity of the system disclosed in the '463 patent has apparently discouraged its use and inhibited it from being a popular system.

As with any system used in a supermarket or the like, the system must be both practical and cost effective. It is unlikely that a store would be willing to spend a large amount of money for the control of a single row of merchandise when there are thousands of items in a store which require a comparable system.

Another problem with the system disclosed in the '463 patent is that once a consumer has removed an item from the display and decides not to buy it, it will be necessary for the consumer to overcome the power of the forward thrust of the spring to place the item back into the queue. Most consumers become annoyed at such inconvenience and it is likely that the item will be left somewhere else in the store because most people usually refuse to be bothered with a system requiring some effort.

U.S. Pat. No. 5,240,126 to Foster also uses a spring arrangement to advance a row of items forward; however, rather than a coil spring used in the '463 patent, it uses a ribbon spring similar to the spring used in a tape measure. The system disclosed in the '126 patent is very effective if used for the weight of the item it is designed for, but it is not adaptable to a wide range of items of different weights. Accordingly, the '126 patent has the same limitations as the system disclosed in the '463 patent. Additionally, products having expiration dates come in all shapes and sizes and need to be rotated. This spring also does not have a mechanism that facilitates the efficient rotation of products including perishable products.

U.S. Pat. No. 5,240,125 to Kunz is similar to the '126 patent, with a similar "tape measure" type spring except that a protective wire grid has been added to prevent a glass jar from falling out of the device. Thus, the '125 patent has similar disadvantages as the '126 patent. Also, the wire grid makes removing old products for the rotation of products even more difficult leading to the likelihood that it will not be performed.

U.S. Pat. No. 5,123,546 to Crum is very similar to the '126 patent with a "tape measure" type spring to propel the row of items forward. The '546 patent has the same limitations in that it must be specifically tailored to a particular item such as cigarette packages, or birthday candles packages which are similar in size and shape to a cigarette package. Furthermore, it must be designed specifically for the display shelf it is to be mounted upon. The system of the '546 patent is currently in use in stores and it appears satisfactory for relatively small, light weight products such as cigarette boxes and birthday candle cartons. It may be feasible to construct a larger system based on the '546 patent for other specific packages, shelf sizes, weights of items, etc., but it is unlikely that this would be cost effective.

BRIEF SUMMARY OF THE INVENTION

In one embodiment according to the invention, a system for displaying products generally forming a queue having a rear product on a display surface having a rear portion and a front portion, comprising an arranging mechanism operable for moving the products selectively and manually from the rear portion of the display surface towards the front portion of the display surface. The arranging mechanism comprises a positioning element having a vertical portion adapted to engage the rear product in the queue from a rear side of the rear product towards the front portion of the display surface and having a horizontal portion extending generally parallel to the display surface. The system further has a supporting mechanism on each of the products that defines an open pathway from one side of one of the products to a substantially opposite side of the one of the products. The open pathway is adapted to receive the horizontal portion of the arranging mechanism. The horizontal portion is positioned in each of the open pathways and extends under the products so that the vertical portion is positioned to engage the rear product in the vicinity of its geometric center, thereby allowing the rear product to be engaged by the vertical portion for movement from a position in the rear portion to a predetermined position closer to the front portion of the display surface.

In yet another embodiment according to the invention, an apparatus for attaching to a surface of a product comprising an attaching mechanism operable for attaching the apparatus to the surface of the product. A supporting mechanism defining an open pathway from one side of the product to a substantially opposite side of the product. The open pathway being adapted to receive a positioning element.

In yet another embodiment according to the invention, a method for arranging and displaying products generally forming a queue having a rear product comprising the steps of providing a shelf generally for receiving products to be displayed and having a front and rear portion. Next, providing products for arrangement and display wherein each of said products has a supporting mechanism. Then providing an arranging mechanism comprising a positioning element having a vertical portion adapted to engage the rear product in the queue from a rear side of the rear product and having a horizontal portion extending generally parallel to the shelf; wherein the supporting mechanism defines an open pathway from one side of one of the products to a substantially opposite side of the one of the products. The open pathway being adapted to receive the horizontal portion. Then positioning the arranging mechanism in the open pathway of each of the products so that the vertical portion is set to engage the rear product in the queue in the vicinity of its geometric center generally corresponding to the center of gravity of the rear product, thereby allowing the rear product to be engaged by the vertical portion for movement from a position in the rear portion to a predetermined position closer to the front portion of the shelf. Then selectively moving the products manually from the rear portion of the shelf towards the front portion of the shelf by applying a force on the horizontal portion of the element generally in a direction towards the front portion of the shelf, thereby engaging the rear product with the vertical portion until a first product in the queue is located at a predetermined position near the front portion of the shelf. Finally, returning the element to its original position by applying a force on the horizontal portion of the element generally in a direction towards the rear portion of the shelf until the element reaches its original position.

BRIEF DESCRIPTION OF THE SEVERAL VIEWS OF THE DRAWING

FIG. 15*a* is a bottom plan view of an embodiment of a support platform according to the invention.

FIG. 15*b* is a cross sectional view of a triangular support portion shown on the support platform in FIG. 15*a* according to the invention.

FIG. 15*c* is a bottom plan view of the embodiment shown in FIG. 15*a* having received a positioning element in an available open pathway according to the invention.

FIG. 15*d* is a bottom plan view of the embodiment shown in FIG. 15*a* with a positioning element shown unable to be received except by an open pathway according to the invention.

DETAILED DESCRIPTION OF THE INVENTION

Figure 1A:
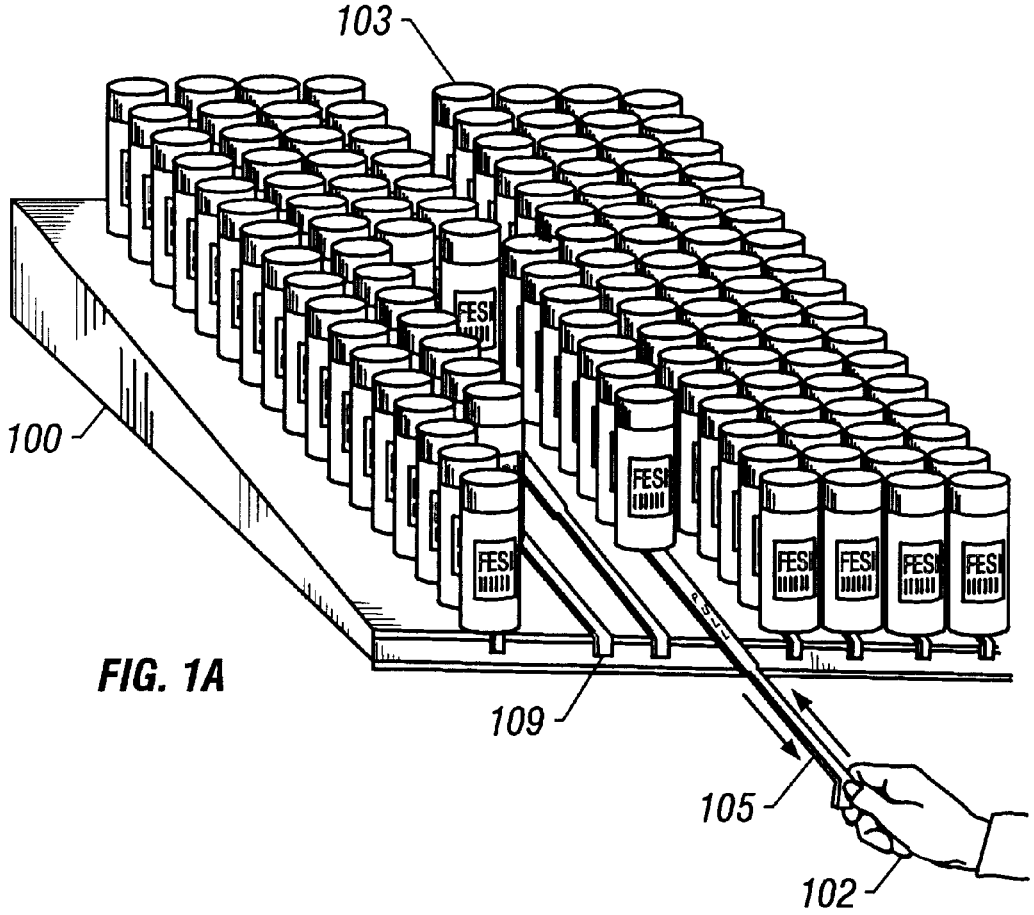
FIG. 1*a* is a perspective view of one embodiment of the system according to the invention.

FIG. 1*a* shows a display shelf 100 having a group of products arranged to define queues of products 103. Consumers remove the products from the display shelf 100 which results in empty shelf space towards the front of display shelf 100 and hard to see products positioned towards the back of display shelf 100. A positioning element 105 according to the invention is positioned under the queue of products 103. A clerk 102 may reposition each queue of products towards the front of the display shelf 100 according to the invention by pulling the positioning element 105 towards the front of the display shelf 100. Positioning element 105 has a vertical portion that engages the rear surface of a product in the queue of products 103 and causes the entire queue of products 103 to move to a position nearer the front of display shelf 100.

Figure 1B:
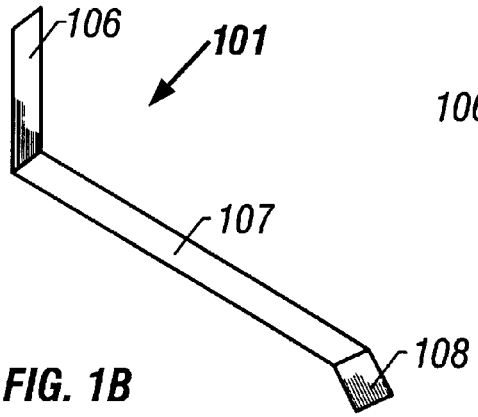
FIG. 1*b* is a perspective view of an embodiment of a positioning element according to the invention.
Figure 1C:
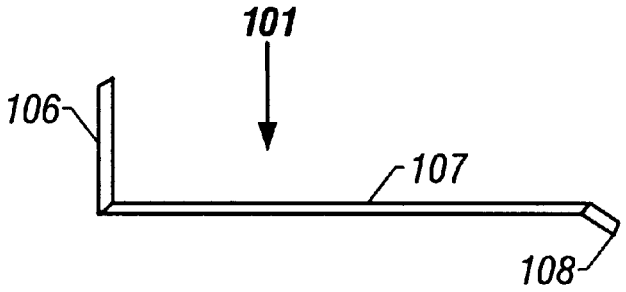
FIG. 1*c* is a side elevational view of the positioning element shown in FIG. 1*b* according to the invention.

FIGS. 1*b* and 1*c* show an embodiment of a positioning element according to the invention. Positioning element 101 has a vertical portion 106 a horizontal portion 107 and an angled portion 108. Positioning element 101 is dimensioned to be placed under a queue or row of products having a defined open pathway adapted for receiving the positioning element 101. Vertical portion 106 is designed and positioned to engage the rear product in the queue of products in the vicinity of the product's geometric center generally corresponding to the center of gravity of the rear product, thereby allowing the rear product to be engaged by the vertical portion 106 for movement from a position in the rear portion of a display shelf to a predetermined position closer to the front portion of a display shelf with a minimum of forces tending to move the rear products. Angled portion 108 is designed to allow a clerk grip the positioning element 101 more efficiently and effectively. Further, angled portion 108 identifies a stopping point when repositioning the positioning element 101 on the display shelf in a non engaging position, as shown by positioning element 109 in FIG. 1*a*.

Figure 2A:
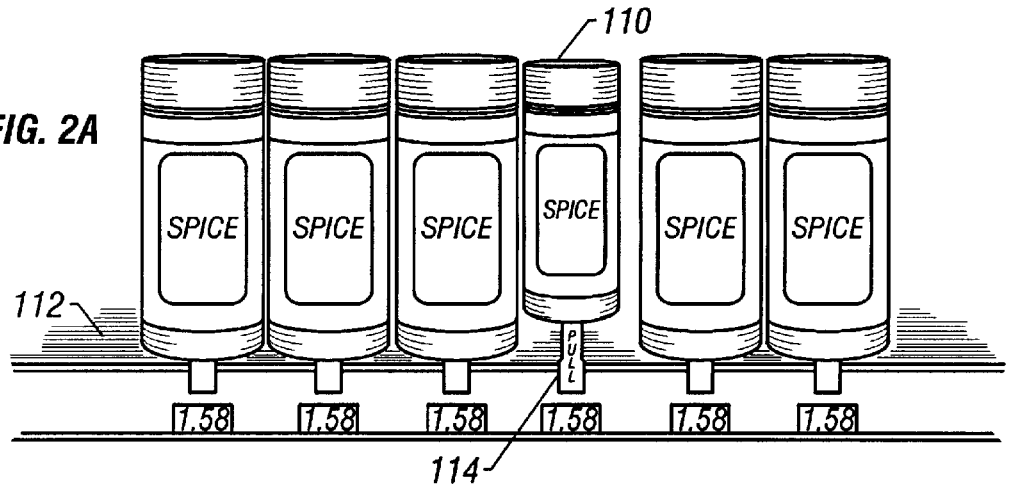
FIG. 2*a* is a front elevational view of an embodiment of the system according to the invention.
Figure 2B:
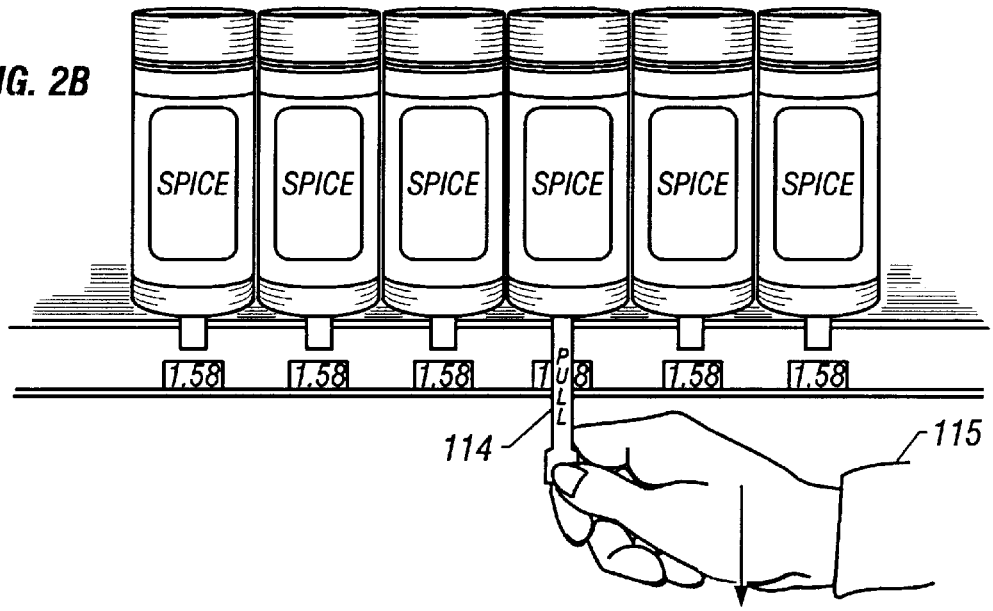
FIG. 2*b* is a front elevational view of an embodiment of the system according to the invention.
Figure 2C:
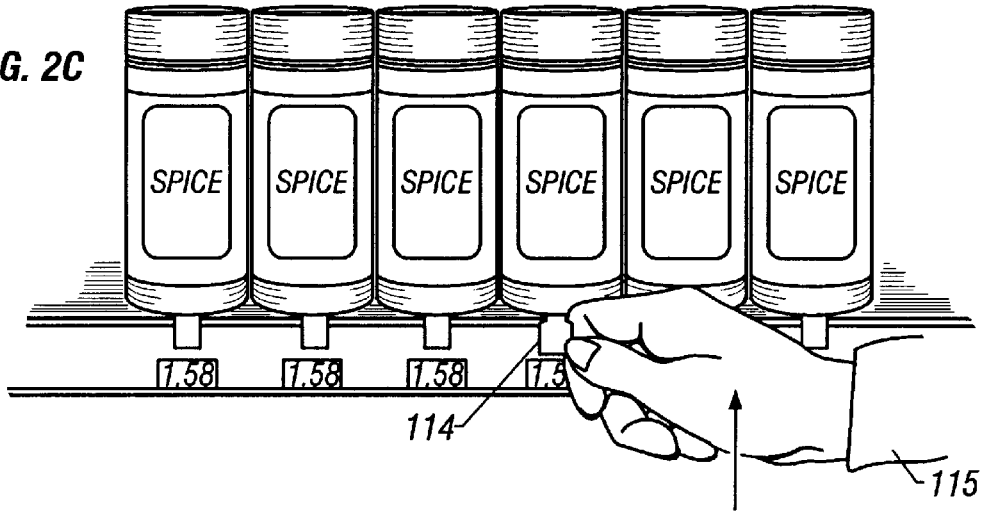
FIG. 2*c* is a front elevational view of an embodiment of the system according to the invention.
Figure 3A:
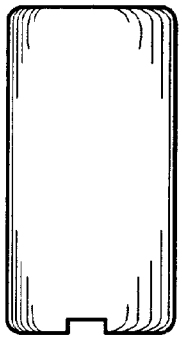
FIG. 3*a* is a front elevational view of a product container having support portions and a defined open pathway in the form of a channel according to the invention.
Figure 3B:
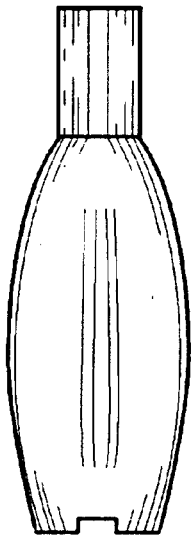
FIG. 3*b* is a front elevational view of a product container having support portions and a defined open pathway in the form of a channel according to the invention.
Figure 3C:
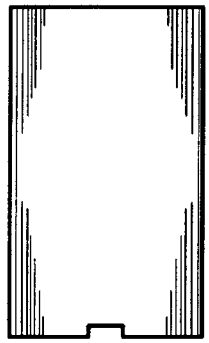
FIG. 3*c* is a front elevational view of a product container having support portions and a defined open pathway in the form of a channel according to the invention.
Figure 3D:
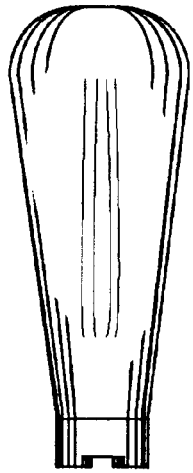
FIG. 3*d* is a front elevational view of a product container having support portions and a defined open pathway in the form of a channel according to the invention.
Figure 3E:
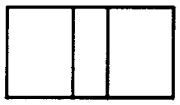
FIG. 3*e* is a bottom plan view of the product container shown in FIG. 3*a*.
Figure 3F:
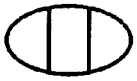
FIG. 3*f* is a bottom plan view of the product container shown in FIG. 3*b*.
Figure 3G:
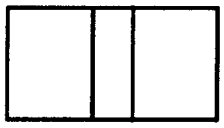
FIG. 3*g* is a bottom plan view of the product container shown in FIG. 3*c*.
Figure 3H:
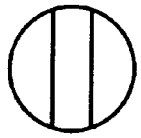
FIG. 3*h* is a bottom plan view of the product container shown in FIG. 3*d*.

FIGS. 2*a*, 2*b*, and 2*c* show the method of repositioning or "fronting" a queue of products. A queue of products 110 is positioned on top of a positioning element 114 on a display shelf 112. The queue of products 110 does not contain enough products to cover the width of the display shelf 112 and the products are not as close to the front of display shelf 112 as they could be. It is therefore necessary to reposition the queue of products 110 closer to the front of display shelf 112. A clerk 115 pulls positioning element 114 towards the front of the display shelf 112. A vertical portion of positioning element 114 engages the rear product in queue 110 and causes the queue of products 110 to move towards the front of display shelf 112 thereby "fronting" and repositioning the queue of products. The positioning element 114 is then maneuvered towards the back of the display shelf 112 until its edge is generally even with the front edge of the display shelf 112 as shown in FIG. 2*c*. Because the products have now been "fronted", they are more accessible to consumers. Further, a uniform shelf of "fronted" products gives the impression of a well kept store and makes products more appealing to the consumer.

Another major advantage of the system according to the invention is that it enables a store clerk to easily stack or position products on a shelf. As new products arrive they need to be placed on a shelf. Rather than reaching to the back of the display shelf 112 to place the first product and then each additional product, the clerk may place the product on the positioning element 114 according to the invention. The positioning element 114 acts as a guide and inhibits products from moving out of the generally straight queue as additional products are placed in the front of the queue and the other products are repositioned along the positioning element 114 by the engagement of the newly placed product. The positioning element 114 guides the queue of products until the maximum number of products in the queue has been reached.

In the prior art, products placed in a queue on a display shelf have containers that have a generally flat bottom surface. A prior art product container having a generally flat bottom surface does not allow for the free movement of a positioning element under the product between the display shelf and the product. For a positioning element to be maneuvered according to the invention there needs to be defined an open pathway that is adapted and dimensioned to receive a positioning element according to the invention.

Figure 4:
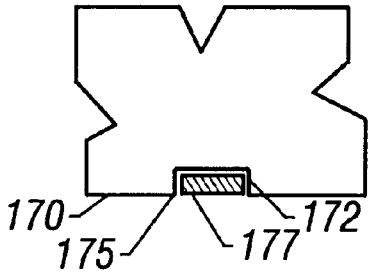
FIG. 4 is a front elevational view of a product container with portions removed.

FIG. 4 shows a front elevational view of a product container with portions removed whose bottom has been formed with two support portions 170 and 172 that between them define an open pathway 175 in the form of a channel. In addition, in the open path way 175 is a positioning element 177 that is dimensioned to be received by the open pathway 175, thereby enabling the positioning element 177 to be moved within the defined open pathway independently of the product container.

FIGS. 3*a*–3*d* show four products container shapes that have been modified to comprise at least two support portions that define an open pathway in the form of a channel dimensioned and adapted to receive a positioning element. FIGS. 3*e*–3*h* show a bottom plan view of the product containers shown in FIGS. 3*a*–3*d* respectively. The defined open pathway continues unobstructed from the front of the product container to the substantially opposite side of the product container.

It is recognized that reformation of product containers may be a costly undertaking. Therefore it may be necessary to modify existing product containers to include a support platform that has support portions that define an open pathway adapted for receiving a positioning element.

Figure 5A:
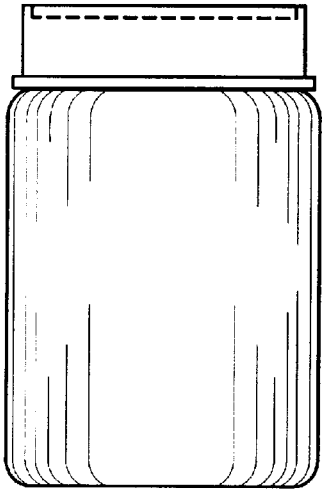
FIG. 5*a* is a front elevational view of a product container .

FIG. 5*a* is a front elevational view of a typical product container that has a generally flat bottom portion and does not have support portions that define an open pathway under the product container.

Figure 5C:
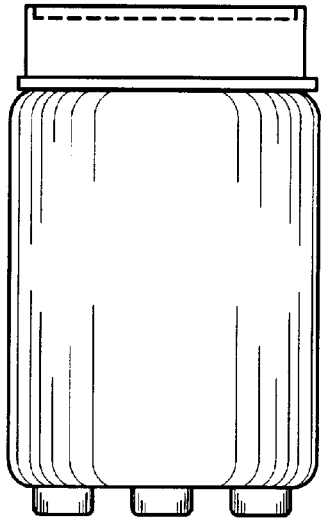
FIG. 5*c* is a front elevational view of a product container having a support platform according to the invention.
Figure 5B:
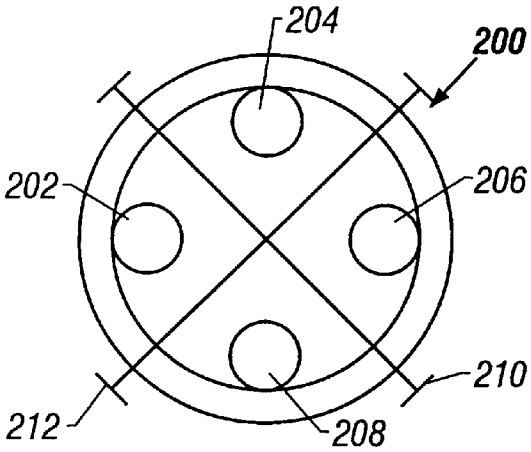
FIG. 5*b* is a bottom plan view of one embodiment of a product support platform according to the invention.

FIG. 5*b* shows a bottom plan view of a support platform 200 having four support portions 202, 204, 206, and 208. The support portions 202, 204, 206 and 208 may be made from rubber, plastic, paper board, glass or any other common material normally used in the manufacture of product containers or support mechanisms. The support platform 200 is dimensioned and made to be attached to the bottom of a product as shown in FIG. 5*c* or molded as an integral portion of the product container. The support platform 200 may be attached with any type of adhesive or it may be made in the mold of the product container as an integral portion of the product container that is not separate from the product container.

Support portions 202, 204, 206, and 208 are positioned on support platform 200 so that two open pathways along lines 210 and 212 are defined. The support portions are dimensioned and spaced apart to define an open pathway that is adapted to receive a predetermined positioning element according to the invention.

Figure 5D:
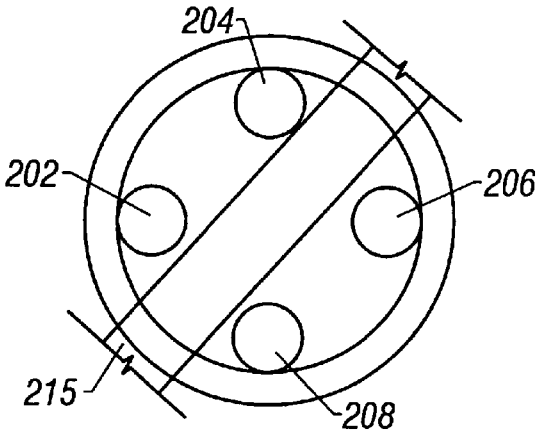
FIG. 5*d* is a bottom plan view of a support platform having received a positioning element according to the invention.
Figure 5E:
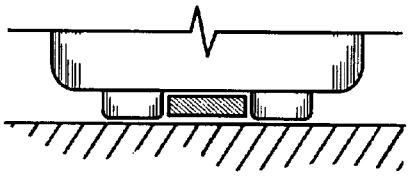
FIG. 5*e* is a side elevational view of the support platform shown in FIG. 5*d* with portions removed having received a positioning element.

FIG. 5*d* shows a positioning element 215 with portions removed positioned in the open pathway defined along line 212 in FIG. 5*b,* defined by and between the set of support portions 202 and 204 and the set of support portions 206 and 208. Positioning element 215 could also be positioned in the open pathway along line 210 in FIG. 5*b,* defined by and between the set of support portions 202 and 208 and the set of support portions 204 and 206. As shown in FIG. 5*e,* the positioning element 215 is dimensioned to be able to move within the defined open pathway independently of the product.

It is generally accepted that a product container has at least one side having a label that is designed to be viewed by a consumer. Research and marketing dollars are spent in the design of the label. It is therefore imperative and a high priority of companies and retailers to have the product label in a position to be easily viewed by a consumer. In the previous embodiment the support portions 202, 204, 206, and 208 together defined at most two open pathways. There is generally a 90 degree angle difference from one defined open pathway to another defined open pathway. Thus a store clerk would be unable to make slight adjustments to the alignment of the product to have the product label in a more optimal position for viewing by a consumer. Attention is needed when attaching the support platform or the label, in the case where the support platform is an integral part of the product container, to make certain that the front label of the product container coincides with a defined open pathway.

The following embodiment overcomes the aforementioned concerns by increasing the number of support portions which in turn increases the number of defined open pathways. Further, by increasing the number of defined open pathways, the angle for adjusting the positioning element from one defined open pathway to another defined open pathway is decreased. Therefore, smaller angular rotations of the product container are enabled for position the product container for optimal viewing of the label affixed thereto.

Figure 6A:
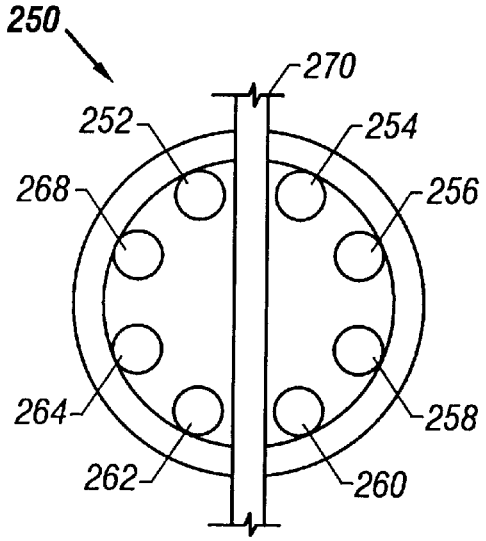
FIG. 6*a* is a bottom plan view of another embodiment of a support platform according to the invention with a positioning element received in a defined open pathway.
Figure 6B:
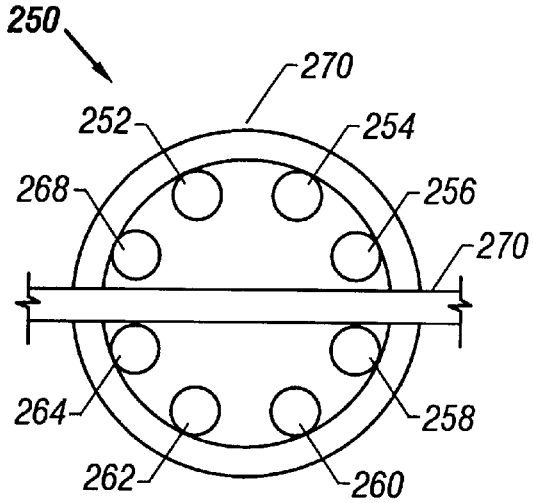
FIG. 6*b* is a bottom plan view of another embodiment of a support platform according to the invention with a positioning element received in another defined open pathway.
Figure 6C:
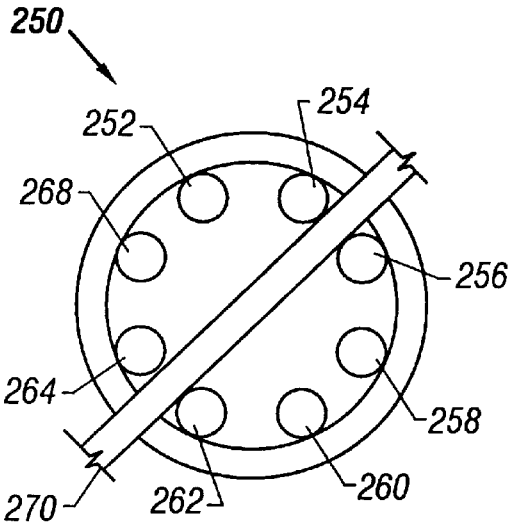
FIG. 6*c* is a bottom plan view of another embodiment of a support platform according to the invention with a positioning element received in another defined open pathway.
Figure 6D:
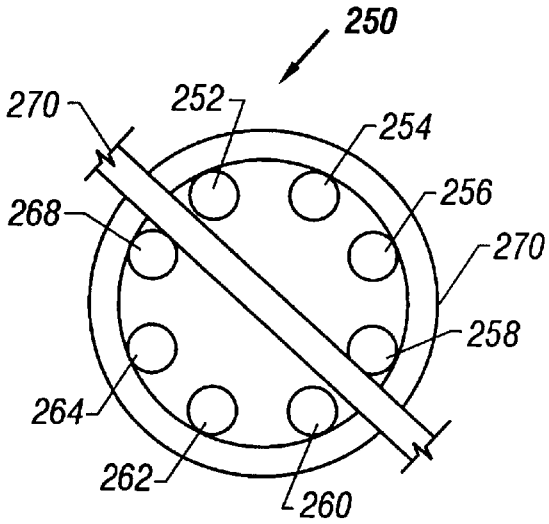
FIG. 6*d* is a bottom plan view of another embodiment of a support platform according to the invention with a positioning element received in another defined open pathway.
Figure 7A:
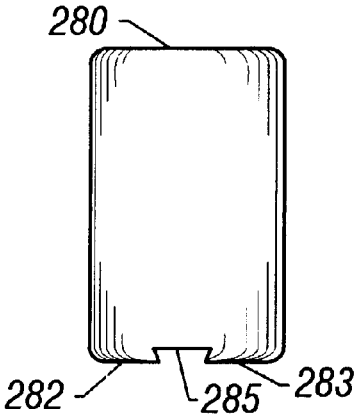
FIG. 7*a* is a front elevational view of another embodiment of a product container having beveled support portions and a defined open pathway according to the invention.
Figure 7B:
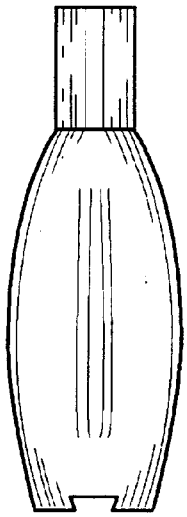
FIG. 7*b* is a front elevational view of another embodiment of a product container having beveled support portions and a defined open pathway according to the invention.
Figure 7C:
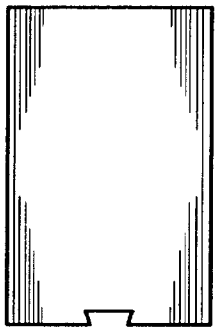
FIG. 7*c* is a front elevational view of another embodiment of a product container having beveled support portions and a defined open pathway according to the invention.
Figure 7D:
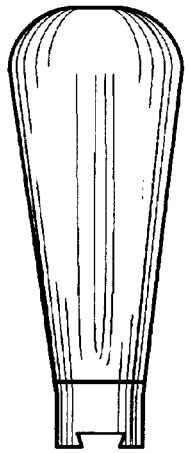
FIG. 7*d* is a front elevational view of another embodiment of a product container having beveled support portions and a defined open pathway according to the invention.

FIG. 6*a* shows a plan view of a support platform 250 with support portions 252, 254, 256, 258, 260, 262, 264 and 268, which define up to 4 different open pathways adapted for receiving a positioning element. A positioning element 270 with portions removed is shown in FIGS. 6*a*–6*d* in each of the possible four open pathways defined by the support portions.

The embodiments described heretofore have disclosed a positioning element and defined open pathway that did not inhibit a product from being separated from the positioning element at any point along the positioning element. In yet another embodiment according to the invention, there is a mechanism whereby a product container having a defined open pathway that has received a positioning element is inhibited from being separated from the positioning element at predetermined portions along the positioning element.

Figure 8B:
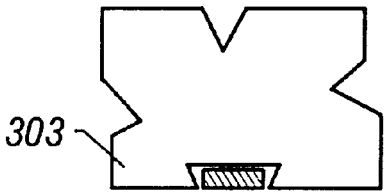
FIG. 8*b* is a front elevational view of the product container in FIG. 8*a* with portions removed having received the non-beveled portion of a positioning element according to the invention.
Figure 8A:
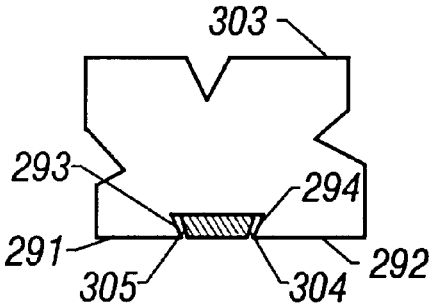
FIG. 8*a* is a front elevational view a product container with portions removed having received the beveled portion of a positioning element according to the invention.

FIGS. 7*a*–7*d* show generic product containers of differing shapes and sizes that are similar to those shown in FIGS. 3*a*–3*d*. Product container 280 shown in FIG. 7*a* has a pair of support portions 282 and 283 that define an open pathway 285 in the form of a channel. The walls of support portions 282 and 283 that define the open pathway 285 are beveled inward from the top of the open pathway toward the bottom open end of the open pathway, as seen in FIG. 8*a*. FIG. 8*a* shows a front elevational view of a product container 303 with portions removed. Support portions 291 and 292 have walls 293 and 294 that are beveled downward and inward towards the bottom of the product container that define an open pathway whose width increases from the bottom and opening of the open pathway to the top of the open pathway which is the bottom of the product container.

Figure 9A:
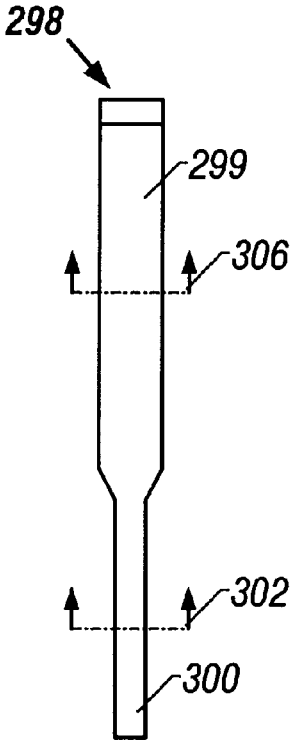
FIG. 9*a* is a top plan view of one embodiment of a positioning element according to the invention.
Figure 9B:
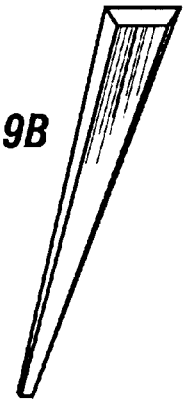
FIG. 9*b* is a perspective view of the beveled portion of one embodiment of a positioning element according to the invention.
Figure 9C:
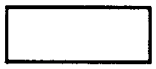
FIG. 9*c* is a view of the cross section of a portion of the positioning element shown in FIG. 9*a* along the line 302.
Figure 9D:
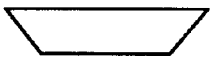
FIG. 9*d* is a view of the cross section of a portion of the positioning element shown in FIG. 9*a* along the line 306.

FIG. 9*a* shows a top plan view of a positioning element 298 having a portion 299 that is wider than an adjacent portion 300. FIG. 9*c* is a view of the cross section of the portion along the line 302 of the positioning element 298. The width of portion 300 of positioning element 298 is dimensioned to be received by a defined open pathway as shown in FIG. 8*b*. Portion 300 enables a product to be placed on or removed from the positioning element 298. A product container 303 is placed on the positioning element 298 along portion 300. The product container is then maneuvered along the positioning element 298 to portion 299. FIG. 9*b* shows a perspective view of portion 299 having beveled edges as shown in FIG. 8*a*. The beveled edges 304 and 305 of positioning element 290 and portion 299 engage the beveled walls 293 and 294 when the product container 303 is pulled away from the positioning element 298, thus inhibiting the separation of the product container 303 and the positioning element 298. FIG. 9*d* is a view of the cross section of the portion along the line 306 of the positioning element 298.

FIGS. 10*a*–10*g* show yet another embodiment according to the invention. As disclosed in FIGS. 10*a*–10*g* a support platform may be integrated into a product container or manufactured separately as a support platform for attaching to existing product containers.

Figure 10A:
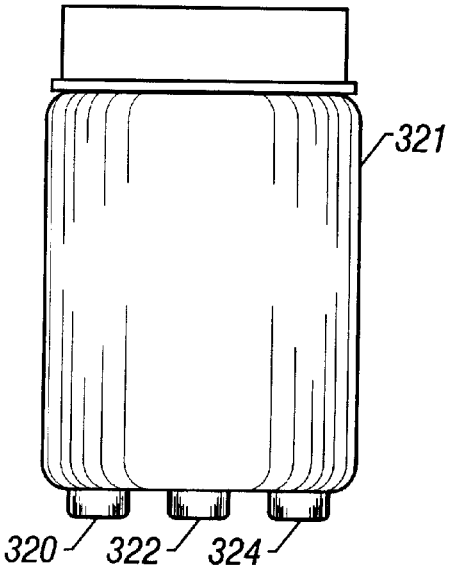
FIG. 10*a* is a front elevational view of one embodiment of a product container with an embodiment of a support platform according to the invention.
Figure 10B:
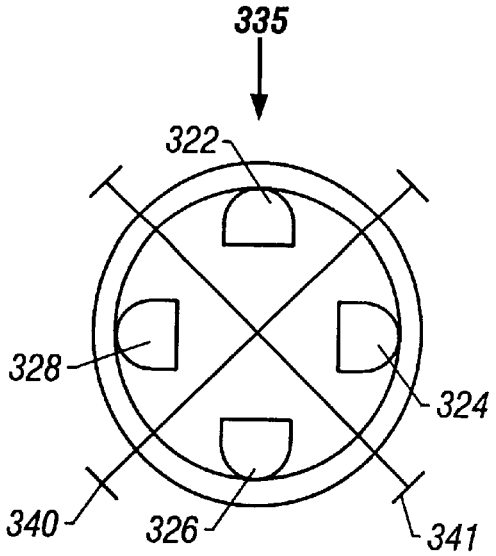
FIG. 10*b* is a bottom plan view of the product container shown in FIG. 10*a*.

FIG. 10*a* shows a front elevational view of a product container 321 having a support platform with three visible support portions 320, 322, 324. FIG. 10*b* is bottom plan view of product container 321 in with platform 335 with support portions 320, 322, 324, and 326. Support portions 320, 322, 324, and 326 are shaped and dimension similar to the support portion 330 shown in FIGS. 10*c* and 10*d*.

Figure 10C:
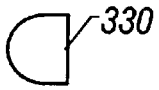
FIG. 10*c* is a bottom plan view of a support portion according to the invention.
Figure 10D:
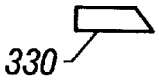
FIG. 10*d* is a side elevational view of the support portion shown in FIG. 10*c* according to the invention.

FIG. 10*c* is a bottom plan view of a support portion 330. FIG. 10*d* is a side elevational view of support portion 330. Support portion 330 has a rounded side and a squared side. The squared side is beveled so that the surface area of the top is greater and the surface area of the bottom. The bottom surface with less surface area is attached to the surface of a support platform so that the support portion 330 extends further outward as the support portion extends away from the support platform.

Figure 10E:
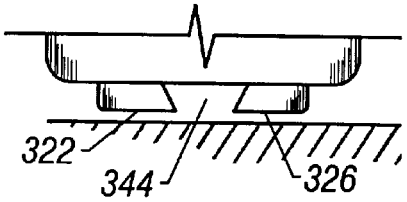
FIG. 10*e* is a side elevational view with portions removed of the product container shown in FIG. 10*b* according to the invention.
Figure 10F:
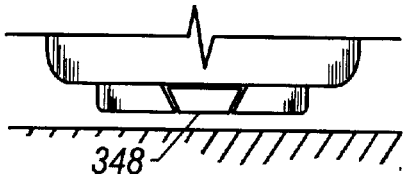
FIG. 10*f* is a side elevational view with portions removed of the product container shown in FIG. 10*b* having received a portion of a positioning element according to the invention.
Figure 10G:
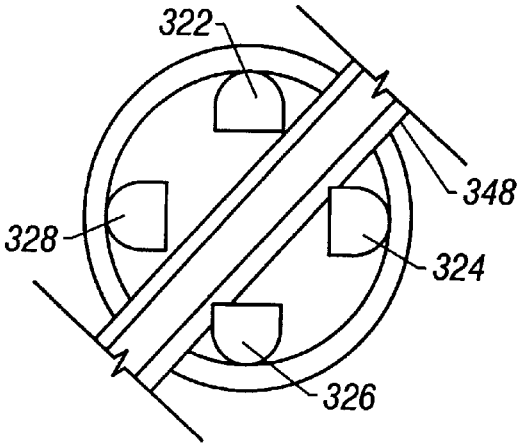
FIG. 10*g* is a bottom plan view of the product container shown in FIG. 10*f* having received a positioning element with portions removed according to the invention.

FIG. 10*b* shows four support portions 320, 322, 324, 326 attached to support platform 335. FIG. 10*e* is a side elevational view with portions removed of the support platform 335 in the direction of line 340 as shown in FIG. 10*b*. Open pathway 344 is defined by and between the set of support portions 320 and 322 and the set of support portions 326 and 324. A positioning element 348 similar to that shown in FIGS. 9*a*–9*c* is shown as received in the open pathway 344 in FIG. 10*f*. FIG. 10*g* is a bottom plan view with portions removed of a positioning element 348 received in open pathway 348.

Support portions are placed on support platform 335 with support portion 322 facing across from support portion 326 and with support portion 328 facing across from 324 as shown in FIGS. 10*b* and 10*e*. This placement defines an open pathway along the line 340 and an open pathway to be defined along the line 341. Other placements of the support portions may also be used to define one or more other open pathways.

Figure 11A:
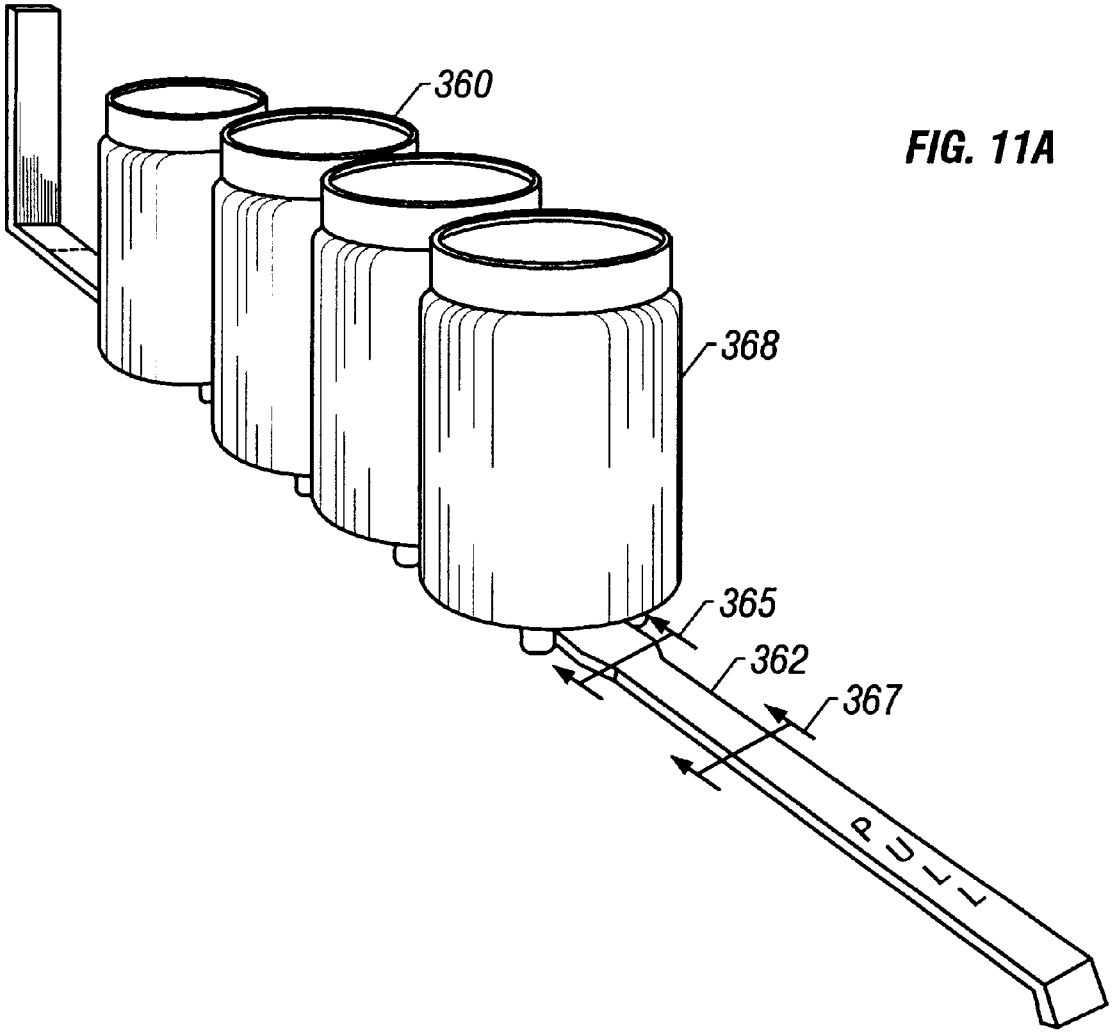
FIG. 11*a* is a perspective view of another embodiment of the system according to the invention.
Figure 11B:
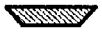
FIG. 11*b* is a view of the cross section of a portion of the positioning element shown in FIG. 11*a* along the line 365.
Figure 11C:
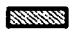
FIG. 11*c* is a view of the cross section of a portion of the positioning element shown in FIG. 11*a* along the line 367.

FIG. 11*a* is a perspective view according to the invention of a queue of products 360 having support platforms and support portions that form an open pathway that has received a positioning element 362 according to the invention. The positioning element 362 has a beveled portion and a rectangular portion. FIG. 11*b* is a view of the cross section of a portion of positioning element 362 along the line 365 representing the beveled portion. FIG. 11*c* is a view of the cross section of positioning element 362 along the line 367 representing the rectangular portion. To separate product 368 from positioning element 362, it must be moved along the positioning element 362 until only the rectangular portion of positioning element 362 is in the open pathway defined by the support portions of product 368.

Figure 12A:
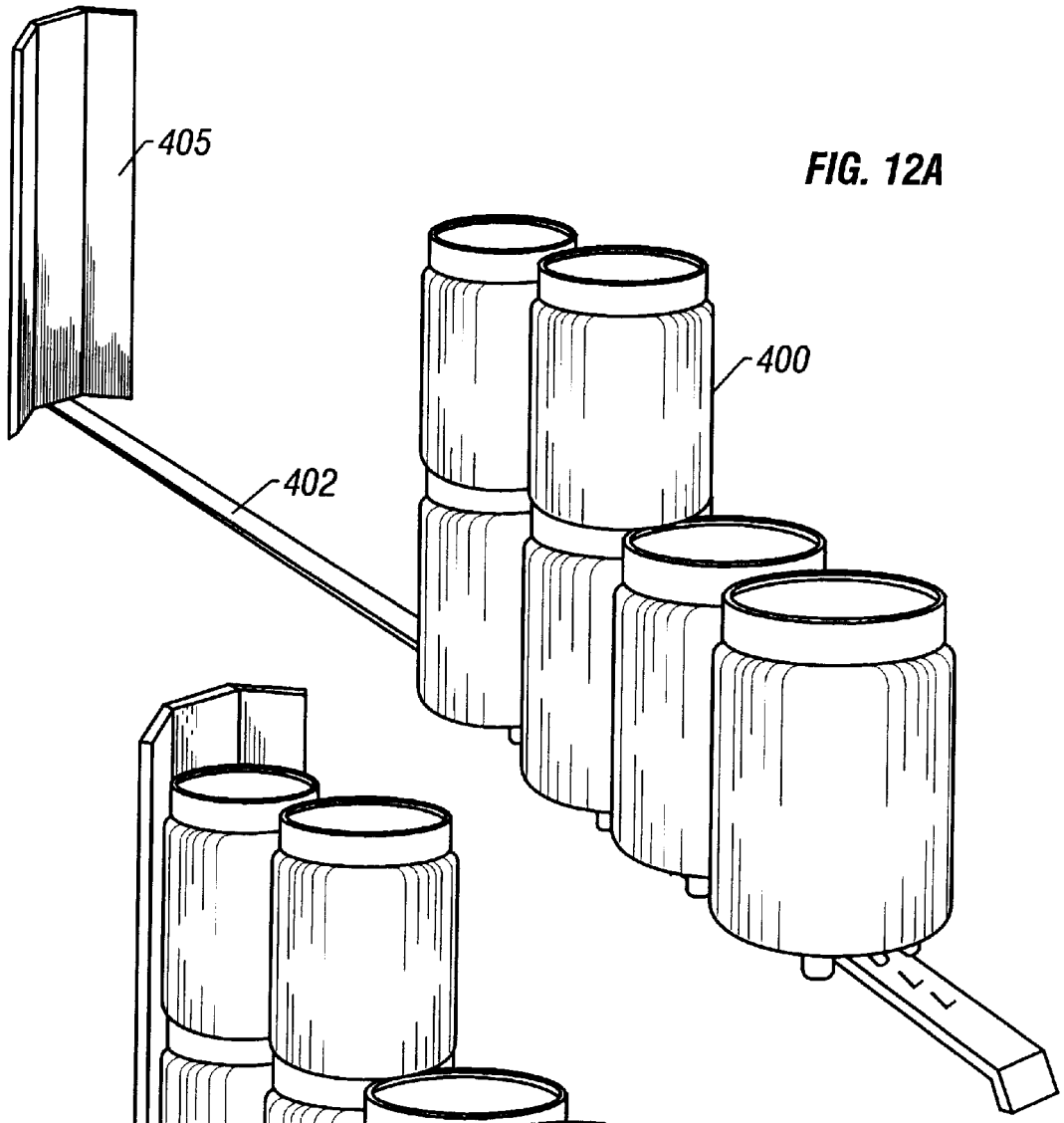
FIG. 12*a* is a perspective view of another embodiment of the system according to the invention.
Figure 12B:
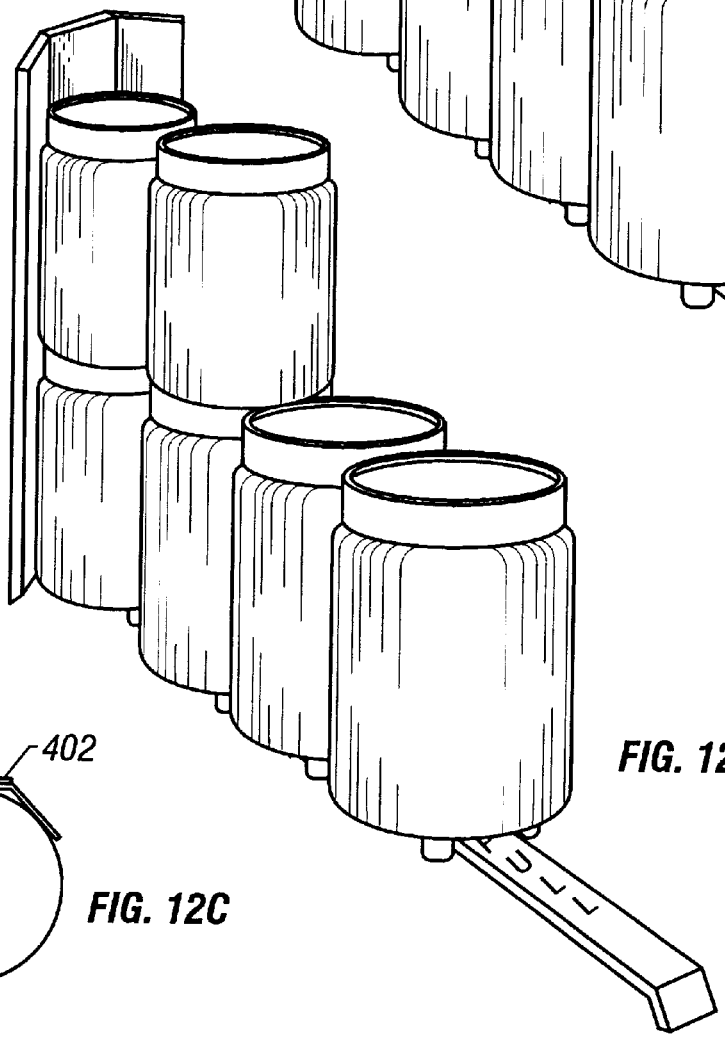
FIG. 12*b* is a perspective view of the system shown in FIG. 12*a* with the rear extension support having engaged the rear products in the queue of products.
Figure 12C:
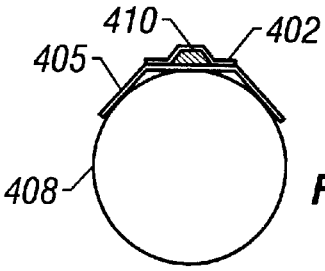
FIG. 12*c* is a top plan view of the extension support having engaged a rear product.

FIGS. 12*a*–12*c* show another embodiment according to the invention. A queue of products 400 sits atop a positioning element 402 according to the invention. The vertical portion of the positioning element 402 according to the invention is proportionate to the width of the positioning element. An extension support element 405 is attached to the vertical portion of the positioning element 402. The extension support element 405 effectively increases the contact surface area of the vertical portion of the positioning element 402. The queue of products 400 contains products that are stacked one on top of another. The extension support element 405 is high enough to engage the top product as shown in FIG. 12*b*.

The extension support element 405 is contoured and shaped to engage a cylinder shaped product container. A flat non contoured extension support element could also be used. FIG. 12*c* is a top plan view of extension support element 405 engaging a product container 408. Extension support element 405 is dimensioned to have an open pathway in the form of a channel 410 adapted to receive the vertical portion of positioning element 402 as shown in FIG. 12*c*.

Figure 13A:
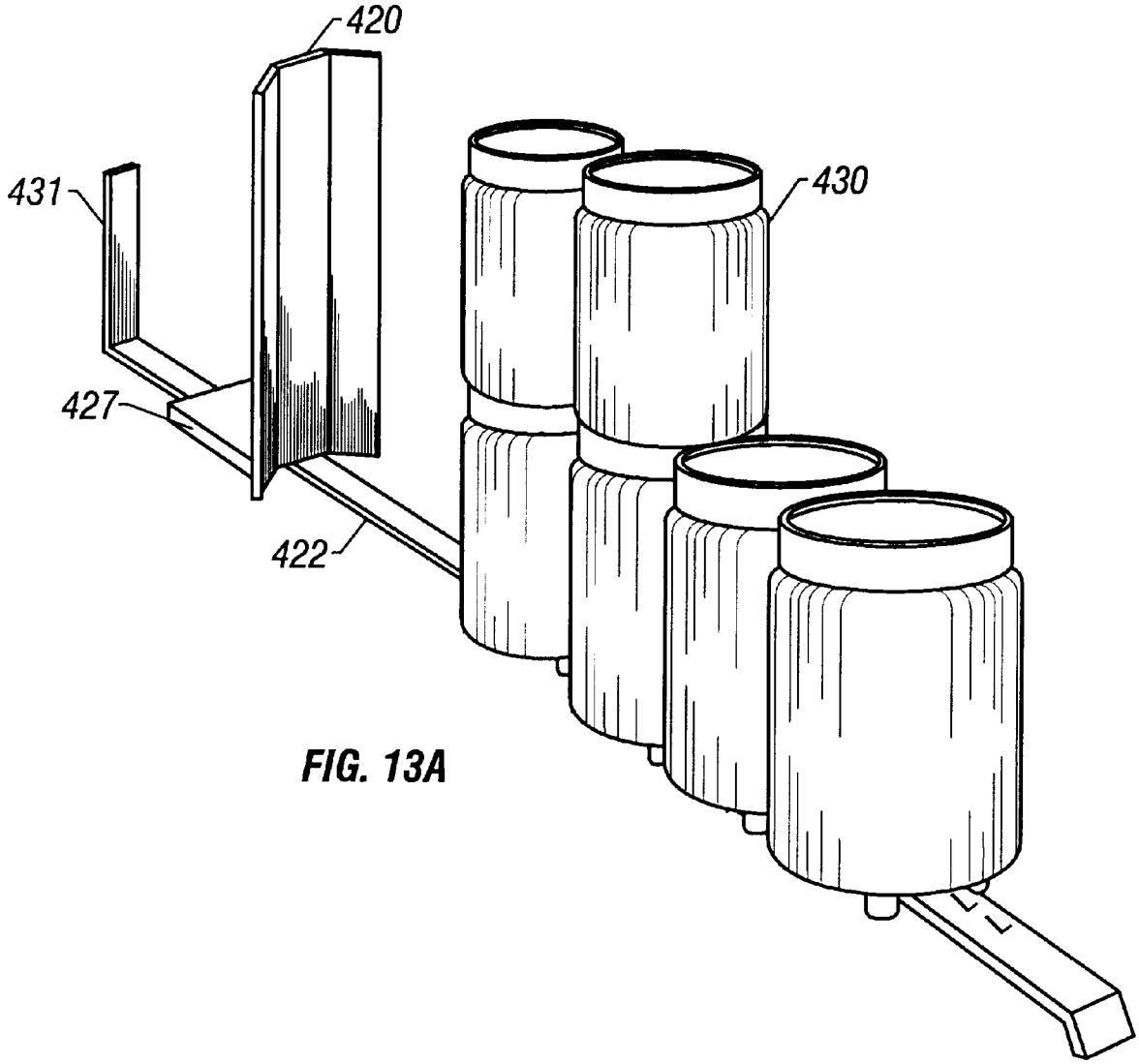
FIG. 13*a* is a perspective view of another embodiment of a rear extension support according to the invention.
Figure 13B:
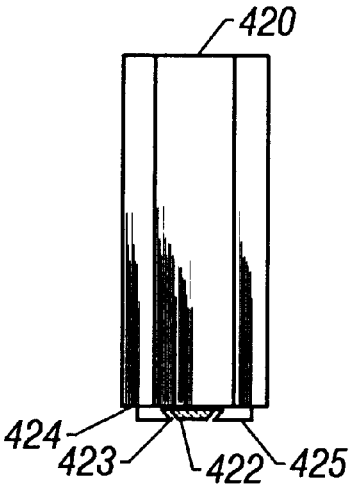
FIG. 13*b* is a front elevational view of the extension support according to the invention.

FIGS. 13*a* and 13*b* show another embodiment of an extension support element according to the invention. Extension support element 420 attaches to the horizontal portion of positioning element 422. Extension support element 420 has support portions 424 and 425 that are dimensioned with beveled walls and shaped to receive the beveled horizontal portion of positioning element 422. Horizontal portion 427 of extension support element 420 extends along the horizontal portion of the positioning element 422 and is dimensioned and positioned to engage the vertical portion 431 of positioning element 422 when positioning element 422 is pulled forward according to the invention. Positioning element 422, by engaging horizontal portion 427 will cause extension support element 420 to engage the queue of products 430 and cause the queue of products 430 to be repositioned according to the invention.

Figure 14A:
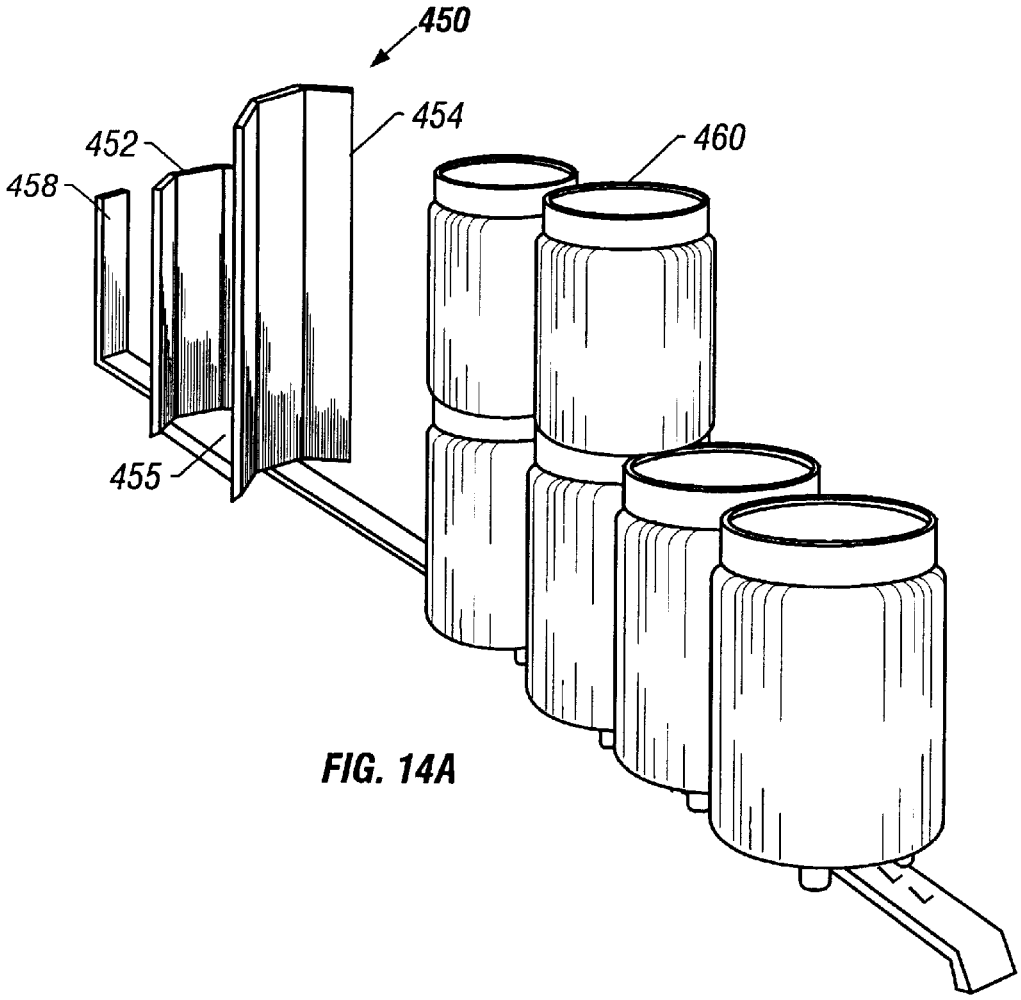
FIG. 14*a* is a perspective view of another embodiment of a rear extension support according to the invention.
Figure 14B:
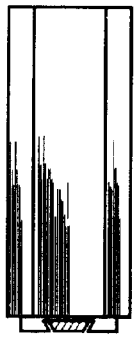
FIG. 14*b* is a front elevational view of the extension support according to the invention having received a positioning element.
Figure 14C:
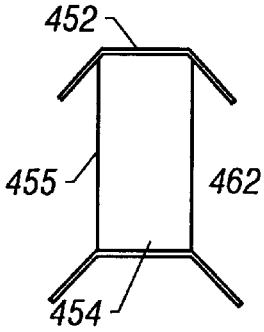
FIG. 14*c* is a top plan view of the extension support according to the invention.

FIGS. 14*a*–14*e* show another embodiment of an extension support element according to the invention. Extension support element 450 has two vertical portions 452 and 454 coupled together by a horizontal portion 455. FIG. 14*c* is a top plan view of extension support element 450. Extension support element 450 is aligned with the positioning element 457 according to the invention in a similar manner as the extension support element 420 in FIGS. 13*a* and 13*b*, as shown in FIG. 14*b*.

Vertical portion 458 of positioning element 457 engages vertical portion 452 of the extension support element 450 which causes vertical portion 454 to engage the queue of products 460.

Figure 14D:
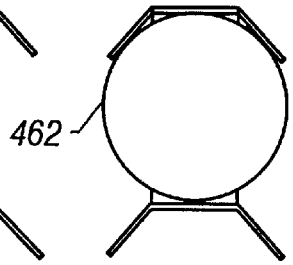
FIG. 14*d* is a top plan view of the extension support having received a product according to the invention.
Figure 14E:
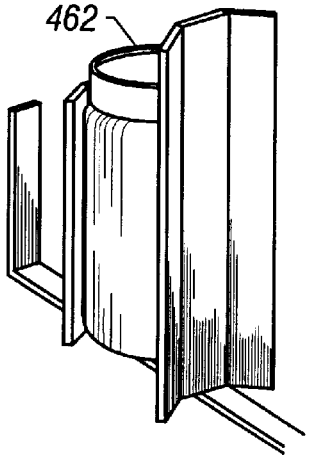
FIG. 14*e* is a perspective view of the extension support shown in FIG. 4*d*.

FIGS. 14*d* and 14*e* show a product container 462 positioned between vertical portions 452 and 454 and resting on top of horizontal portion 455. If vertical portion 454 is transparent, then product 462 would indicate to an observer the type of product that should be placed in the queue when the queue is empty. In addition, the weight of product 462 provides balance and stability to the system in general.

FIGS. 15*a*–15*d* shows yet another embodiment of a support platform according to the invention. FIG. 15*a* is a bottom plan view of a support platform 470 with triangular support portions raised with respect to support platform 470. FIG. 15*b* is a cross sectional view of the triangular support portion 472. A set of two adjacent triangular support portions and the set of two adjacent triangular support portions opposite the first set form an open pathway across the diameter of support platform 470 that is adapted to receive a positioning element.

FIG. 15*c* shows support platform 470 having received a positioning element 474 in an open pathway defined by the set of adjacent triangular support portions 472 and 475 and the set of adjacent triangular portions 476 and 477 respectively opposite triangular portions 472 and 475. The open pathway enables the positioning element 474 to move independently in the open pathway under a product container.

The base portions of the triangular support portions at the periphery shown should be separated from base portions of adjacent triangular support portions at a width greater than the width of the positioning element. The vertices of each triangular support portion should be of sufficient distance from its base portion at the periphery to inhibit a received positioning element from being received another set of triangular support portions except along the diameter of the support platform. FIG. 15*d* shows a positioning element 479 being inhibited from being received by a set of triangular support portions not along the diameter.

Instead of triangular support portions, the same function could also be served by individual support portions at each of the vertices of the triangular support portions shown in FIGS. 15*a*, 15*c*, and 15*d*.

The support platform 470 shown may be a separate support apparatus that is easily attached to a product container by an adhesive or other known method of affixing to a product container. Further, the support platform may be made an integral part of a product container and incorporated into a mold for a product container thereby bypassing any need for adhesives. The support platform 470 may be made from plastic or paperboard or any other material using known molding and shaping methods.

Figure 16:
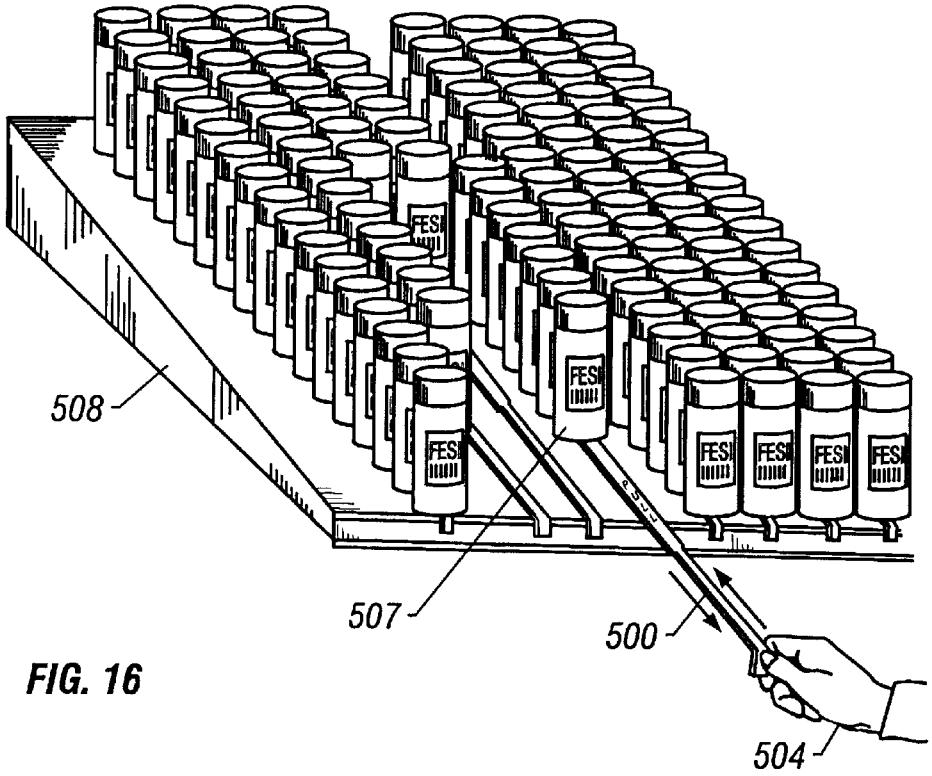
FIG. 16 is a perspective view of another embodiment of the system according to the invention.

FIG. 16 shows the system being implement according to the invention with a positioning element 500 being pulled by a clerk 504 with a queue of products 507 towards the front edge of a display shelf 508 according to the invention. The positioning element 500 has indicia representing numbers such that when the vertical portion of the positioning element 500 according to the invention engages the rear product of the queue 507 the indicia number directly in front of the first product in queue 507 indicates the total number of products in the queue. The indicia numbers must be applied to the positioning element in spacial intervals adequate to represent the width of a product that is expected to be placed in the queue 507. Each number represents one product and the numbers are placed in reverse order starting from the vertical portion of the positioning element.

Figure 17:
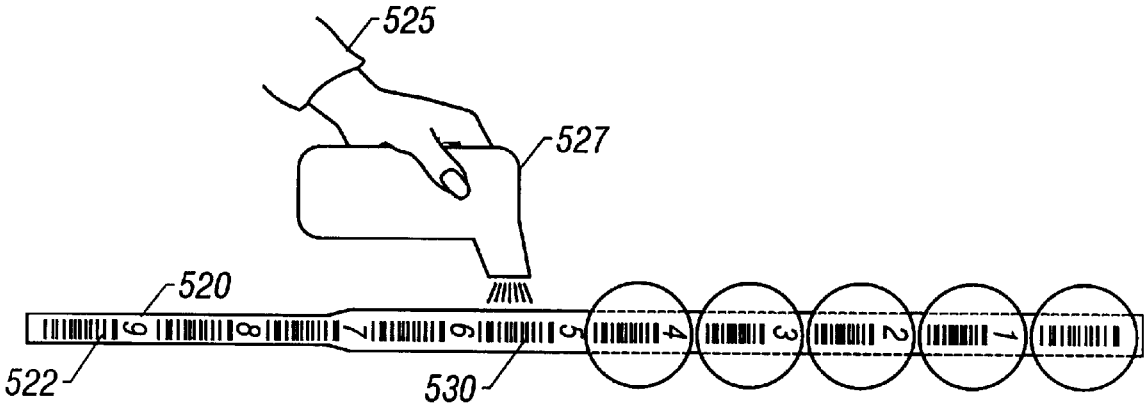
FIG. 17 is a top plan view of another embodiment according to the invention.

FIG. 17 shows a positioning element 520 according to the invention with bar codes 522 and numerical indicia. The bar codes 522 may represent the product id that is expected to be used with the positioning element 520 or may represent the number of products that need to be ordered to take the place of products already sold. A clerk 525 with a bar code reader 527 may scan the first available bar code 530 to determine how many products needed to be ordered.

There has been described herein novel system and methods. It is evident that those skilled in the art may now make numerous uses and modifications of and departures from the specific embodiments described herein without departing from the inventive concepts. Consequently, the invention is to be construed as embracing each and every feature and novel combination of features and steps present or possessed by the system and methods herein disclosed and limited solely by the spirit and scope of the appended claims. Changes may be made in the various elements or assemblies or components or in the steps or in the sequence of steps described herein without departing from the spirit and the scope of the invention as defined in the following claims.

What is claimed is:

1. A system for displaying products generally forming a queue having a rear product on a display surface having a rear portion and a front portion, comprising:

arranging means operable for moving said products selectively and manually from the rear portion of the display surface towards the front portion of the display surface;

said arranging means comprising a positioning element having a vertical portion adapted to engage said rear product in the queue from a rear side of said rear product and having a horizontal portion extending generally parallel to said display surface;

supporting means on each of said products; said supporting means defining an open pathway from one side of one of said products to a substantially opposite side of said one of said products; said open pathway being adapted to receive said horizontal portion;

said horizontal portion being positioned in each of said open pathways and extending under said products so that said vertical portion is positioned to engage said rear product in the vicinity of its geometric center, thereby allowing said rear product to be engaged by said vertical portion for movement from a position in the rear portion to a predetermined position closer to the front portion of said display surface.

2. The system as claimed in claim 1, wherein said positioning element includes indicia identifying the number of products in the queue when said positioning element is moved so that said vertical portion engages the rear product in the queue.

3. The system as claimed in claim 1, wherein said positioning element includes indicia corresponding to the products in the queue.

4. The system as claimed in claim 3, where said indicia identifies the number of products in the queue when said positioning element is moved so that said vertical portion engages the rear product in said queue.

5. The system as claimed in claim 3, wherein said indicia is a bar code.

6. The system as claimed in claim 1, further comprising an enhancing means for enhancing the distribution of a force on the rear surface of the rear product in said queue so that the force is distributed over a predetermined larger area.

7. The system as claimed in claim 1, wherein said supporting means comprises a first support portion and a second support portion and said horizontal portion of said positioning element is comprised of a first portion dimensioned to engage said first support portion and said second support portion and inhibit the removal of said positioning element from said channel.

8. The system as claimed in claim 7, wherein said positioning element includes indicia corresponding to the products in the queue.

9. The system as claimed in claim 8, wherein said indicia identifies the number of products in the queue when said positioning element is moved so that the products are substantially aligned with the front portion of said display surface.

10. The system as claimed in claim 8, wherein said indicia is a bar code.

11. The system as claimed in claim 9, further comprising an enhancing means for enhancing the distribution of a force on the rear surface of the rear product in said queue so that the force is distributed over a predetermined larger area.

12. The system as claimed in claim 1, wherein said supporting means is comprised of four support portions that define at least one open pathway from one side of one of said products to a substantially opposite side of said one of said products; said open pathway being adapted to receive said horizontal portion.

13. The system as claimed in claim 1, wherein said supporting means is comprised of eight support portions that define at least one open pathway from one side of one of said products to a substantially opposite side of said one of said products; said open pathway being adapted to receive said horizontal portion.

14. The system as claimed in claim 12, wherein said support portions are triangularly shaped.

15. The system as claimed in claim 13, wherein said support portions are triangularly shaped.

16. An apparatus for attachment to a surface of a product so that a positioning element can be used to move said product forward on a display shelf comprising:

supporting means defining an open pathway from one side of said product to a substantially opposite side of said product; said open pathway being adapted to receive a positioning element; and an attaching means operable for attaching said supporting means to said surface of said product; whereby a plurality of products generally forming a queue and each of said plurality of products having said apparatus attached can thereby receive said positioning element to enable the movement of said queue of products by said positioning element.

17. The apparatus claimed in claim 16, wherein said supporting means is comprised of four support portions that define at least one open pathway from one side of one of said products to a substantially opposite side of said one of said products; said open pathway being adapted to receive said horizontal portion.

18. The apparatus as claimed in claim 16, wherein said supporting means is comprised of eight support portions that define at least one open pathway from one side of one of said products to a substantially opposite side of said one of said products; said open pathway being adapted to receive said horizontal portion.

19. The apparatus as claimed in claim 17, wherein said support portions are triangularly shaped.

20. The apparatus as claimed in claim 18, wherein said support portions are triangularly shaped.

21. A method for arranging and displaying products generally forming a queue having a rear product comprising the steps of:

providing a shelf generally for receiving products to be displayed and having a front and rear portion;

providing products for arrangement and display; each of said products having a supporting means;

providing an arranging means; said arranging means comprising a positioning element having a vertical portion adapted to engage said rear product in the queue from a rear side of said rear product and having a horizontal portion extending generally parallel to said shelf; wherein said supporting means defines an open pathway from one side of one of said products to a substantially opposite side of said one of said products; said open pathway being adapted to receive said horizontal portion;

positioning said arranging means in said open pathway of each of said products so that said vertical portion is set to engage said rear product in the queue in the vicinity of its geometric center generally corresponding to the center of gravity of said rear product, thereby allowing the rear product to be engaged by said vertical portion for movement from a position in the rear portion to a predetermined position closer to the front portion of said shelf;

selectively moving said products manually from the rear portion of said shelf towards the front portion of said shelf by applying a force on said horizontal portion of said element generally in a direction towards the front portion of the shelf, thereby engaging the rear product with said vertical portion until a first product in said queue is located at a predetermined position near the front portion of the shelf; and returning said element to its original position by applying a force on said horizontal portion of said element generally in a direction towards the rear portion of said shelf until said element reaches its original position.

* * * * *